US009744796B1

(12) United States Patent
Lyon et al.

(10) Patent No.: US 9,744,796 B1
(45) Date of Patent: Aug. 29, 2017

(54) RETRACTABLE WRITING INSTRUMENT

(71) Applicants: Kent David Lyon, Cypress, TX (US); Jym Daniel, Austin, TX (US)

(72) Inventors: Kent David Lyon, Cypress, TX (US); Jym Daniel, Austin, TX (US)

( * ) Notice: Subject to any disclaimer, the term of this patent is extended or adjusted under 35 U.S.C. 154(b) by 0 days.

(21) Appl. No.: 15/491,969

(22) Filed: Apr. 19, 2017

(51) Int. Cl.
*B43K 24/00* (2006.01)
*B43K 25/02* (2006.01)
*B43K 24/02* (2006.01)

(52) U.S. Cl.
CPC ..... *B43K 24/00* (2013.01); *B43K 24/02* (2013.01); *B43K 25/02* (2013.01)

(58) Field of Classification Search
CPC ..... B43K 8/22; B43K 24/02; B43K 24/08; A45D 34/043; A45D 2040/105; A45D 40/02; A45D 40/023; A45D 40/024; A45D 40/04; A45D 40/06; A45D 40/065; A45D 40/10; A45D 40/12
USPC ..... 401/100
See application file for complete search history.

(56) References Cited

U.S. PATENT DOCUMENTS 2,866,993 A * 1/1959 Edelstone ..... A45D 34/043 15/184
3,063,419 A * 11/1962 Parker ..... B43K 24/02 335/285
3,162,304 A * 12/1964 Bau ..... A45D 40/02 401/61
3,205,863 A 9/1965 Rhoades
3,218,653 A * 11/1965 Colone ..... B43K 29/18 15/433
4,966,483 A * 10/1990 Hashimoto ..... A45D 34/042 222/213
5,505,553 A * 4/1996 Saviano ..... B43K 29/00 401/100
5,911,533 A * 6/1999 Fassler ..... B43K 8/22 401/195
6,499,896 B1 * 12/2002 Sickler ..... B43K 8/22 15/437
6,585,441 B1 * 7/2003 Shamitoff ..... B43K 5/005 401/110
8,821,057 B2 * 9/2014 Lambert ..... A45D 40/18 206/385
2004/0213624 A1 * 10/2004 Petit ..... A45D 40/02 401/100

(Continued)

OTHER PUBLICATIONS

Hribarcain, "MAGNO | The World's First Magneticaly Controlled Pencil," https://www.kickstarter.com/projects/238708282/magno-the-worlds-first-magnetically-controlled-pen?lang=es; Jul. 21, 2016.

*Primary Examiner* — Allana Lewin Bidder
*Assistant Examiner* — Bradley Oliver
(74) *Attorney, Agent, or Firm* — Karen B. Tripp

(57) ABSTRACT

A retractable writing instrument has a marking component for marking a writable surface. A barrel houses at a portion of the marking component, as well as an extension/retraction mechanism. The barrel has a slider portion. An internal magnet is adapted to operate the extension/retraction mechanism and positioned for operating movement along a length of the slider portion for extending and retracting a portion of the marking component. A slidable magnetic ring has an inner diameter for receiving the slider portion and is adapted to magnetically cooperate with the internal magnet.

20 Claims, 5 Drawing Sheets

(56) References Cited

U.S. PATENT DOCUMENTS

| | | | | |
|---|---|---|---|---|
| 2007/0025802 | A1* | 2/2007 | Dieudonat | A45D 40/02 401/100 |
| 2009/0175672 | A1* | 7/2009 | Killion | B43K 23/001 401/100 |
| 2012/0057920 | A1* | 3/2012 | Rolion | B43K 24/02 401/100 |
| 2015/0084933 | A1* | 3/2015 | Kinoshita | G06F 3/0386 345/179 |

* cited by examiner

RETRACTABLE WRITING INSTRUMENT

FIELD OF THE INVENTION

The present invention relates to the field of writing instruments and, in particular, to retractable writing instruments.

BACKGROUND OF THE INVENTION

Many people fidget as a result of nervous energy, stress, agitation, and/or boredom. Others have trouble concentrating and need to move to release energy. Still other studies have shown that fidgeting helps relieve cognitive load by offloading some of the load to movement, thereby freeing up resources to concentrate on a mental process.

Fidgeting is often manifested by playing with one's fingers, hair, jewelry or item of clothing. Alternatively, a person might play with coffee cups, labels on bottles, candy wrappers, paper clips and the like. Still others may click on a retractable pen. These actions may distract others, for example in a classroom or a meeting. However, in many cases, a person who is restrained against fidgeting may not be able to fully concentrate and/or fully absorb what is being said, read or viewed in a particular activity. Many people therefore find they are able to more fully concentrate on a speaker, text they are reading, video they are watching or text they are writing, by fidgeting.

One particularly common type of fidgeting is pen clicking, where a person repeatedly clicks a retractable pen, oftentimes without realizing he/she is doing so. This often is quite distracting for people who are in the same room or nearby.

U.S. Pat. No. 3,205,863 (Rhoades) is one of the earliest disclosures of a retractable pen. A cam body has a plurality of spaced cam surfaces and means coacting with a depressible member and sequentially traversing the cam surfaces to positively rotate the writing unit unidirectionally to successive rotation point-projected positions on successive operation of the depressible member. In the meantime, a spring is used to urge a writing unit rearwardly.

A magnetic mechanical pencil for 2 mm lead was disclosed in a KICKSTARTER™ campaign launched in 2016 under the project name "MAGNO | The World's First Magnetically Controlled Pencil." The rear of the pencil lead is secured at one end in a plastic sleeve connected to a magnet, within an aluminum housing. The front end of the pencil lead is secured at a desired position by jaws of a brass collet. The end tip of the housing is rotated to open or loosen the jaws of a brass collet to allow a marking end of a lead to extend from the front of the mechanical pencil. A ferrous sleeve located around the outside of the housing slides by hand to determine the length of lead extending through the brass collet. The lead is then secured in place by rotating the tip end to tighten the collet around the lead.

The MAGNO™ pencil design appears to be limited to 2 mm lead pencils, since smaller diameter pencil leads tend to be shorter in length and, furthermore, much smaller in diameter, for example 0.5 mm or 0.7 mm. Accordingly, the smaller, thinner leads would tend to break in the type of collet shown in the MAGNO™ disclosure. As well, the shorter lifespan of a smaller diameter and shorter lead would require frequent reloading of each individual lead in the sleeve and magnet assembly. Further, the extension and retraction of a retractable ink cartridge has a different type of challenge not addressed by the MAGNO™ pencil design.

There is a need for a retractable writing instrument that provides a different operating mechanism allows for is sufficiently versatile to allow different types of fidgeting movements. There is also a need for a writing instrument that allows a user to either fidget or readily disengage from fidgeting while using the pen. There is also a need for a writing instrument having a fidgeting component that can provide a secondary function.

SUMMARY OF THE INVENTION

According to one aspect of the present invention, there is provided a retractable writing instrument having a marking component for marking a writable surface, comprising: a first instrument end and a second instrument end, the first instrument end adapted to receive a portion of the marking component; a barrel for housing at least a portion of the marking component, the barrel positioned between the first instrument end and the second instrument end; the barrel further comprising a slider portion proximate the second instrument end; an extension/retraction mechanism housed in the barrel and operably connected to the marking component; an internal magnet adapted to operate the extension/retraction mechanism and positioned for operating movement along a length of the slider portion for extending and retracting a portion of the marking component through the first instrument end; and a slidable magnetic ring having an inner diameter for receiving the slider portion adapted to magnetically cooperate with the internal magnet.

BRIEF DESCRIPTION OF THE DRAWINGS

The device of the present invention will be better understood by referring to the following detailed description of preferred embodiments and the drawings referenced therein, in which.

DETAILED DESCRIPTION OF THE INVENTION

The present invention provides a writing instrument that provides magnetic operation of an extension/retraction mechanism. The magnetic operation further provides a user with the tactile satisfaction of moving a magnet for providing an outlet for relieving nervous energy or stress. In other uses, the writing instrument allows a user to improve cognitive function by offloading cognitive load to a movement enabling a person to better focus, be more attentive and/or improve memory or attention span. In a preferred embodiment, the writing instrument is provided with additional components to allow a user to practice a number of different fidgeting movements, while still allowing the user to use the writing instrument to mark a writable surface.

Figure 1:
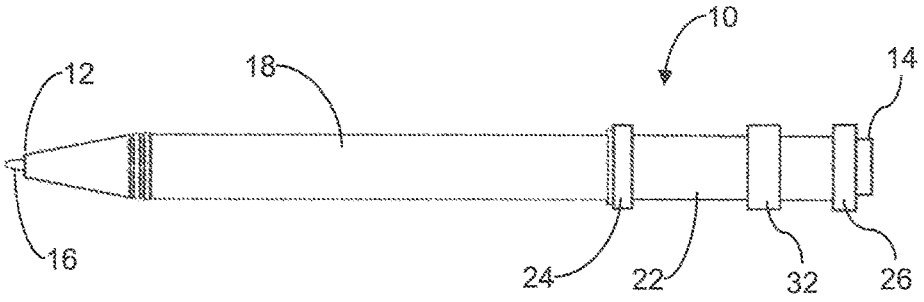
FIG. 1 is a top plan view of one embodiment of the writing instrument of the present invention in an extended state.

Referring now to the drawings, FIG. 1 shows one embodiment of a writing instrument 10 of the present invention. The writing instrument 10 has a marking component for marking a writable surface. The writing instrument 10 may be an ink pen, a pencil, a stylus, a digital pen, a highlighter, a marker, or a combination thereof. The writing instrument 10 is retractable. For convenience, the writing instrument 10 depicted in the drawings is a retractable pen.

The writing instrument 10 has a first instrument end 12 and a second instrument end 14. The first instrument end 12 is adapted to receive a portion of the marking component 16. Thus, in FIG. 1, the writing instrument 10 shows the first instrument end 12 as receiving the tip portion of the marking component 16. Positioned between the first instrument end 12 and the second instrument end 14 is a barrel 18 for housing at least a portion of the marking component 16, for example an ink cartridge (not shown) and an extension/retraction mechanism for operating the writing instrument 10.

The barrel 18 also comprises a slider portion 22 proximate the second instrument end 14. The slider portion 22 is preferably formed of a non-ferrous material, such as aluminum or plastic.

The operation of the writing instrument 10 is performed using an internal magnetic extension/retraction mechanism. The marking component 16 is extended and retracted by causing an internal magnet to push the marking component 16 to and from an extended position by sliding a slidable magnetic ring 32. The slidable magnetic ring 32 has an inner diameter for receiving the slider portion 22 and is provided to magnetically cooperate with an internal magnet for operating the retraction/extension mechanism. The slidable magnetic ring 32 slides along the slider portion 22, for example between slider stops 24, 26. One or both of the slider stops 24, 26 may be magnetic.

Figure 2:
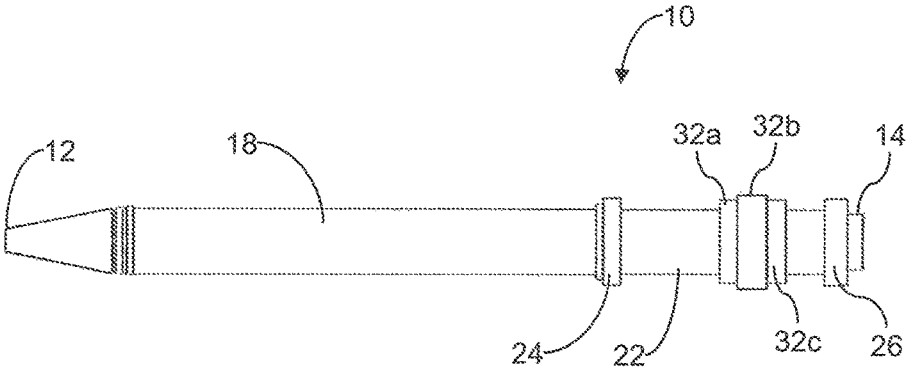
FIG. 2 is a top plan view of another embodiment of the writing instrument of the present invention in a retracted state.

While the inventors have found that writing instrument 10 of the present invention operates with a solid slidable magnetic ring 32. However, the inventors have surprisingly discovered that the retraction/extension mechanism operates with improved performance with a three-part slidable magnetic ring 32, as illustrated in FIG. 2. In that drawing, the slidable magnetic ring 32 has a first magnet ring 32*a*, a middle non-magnet ring 32*b*, and a second magnet ring 32*c*. The first magnet ring 32*a*, the middle non-magnet ring 32*b*, and the second magnet ring 32*c* may be magnetically held together as a unit, or affixed by mechanical means, such as welding, gluing, or the like. In addition to improved performance, the inventors have found that the three-part slidable magnetic ring 32 advantageously has the tactile feel of cradling the internal magnet between the first and second magnet rings 32*a* and 32*c*. Preferably, the middle non-magnet ring 32*b* is formed of a ferrous material.

Figure 3:
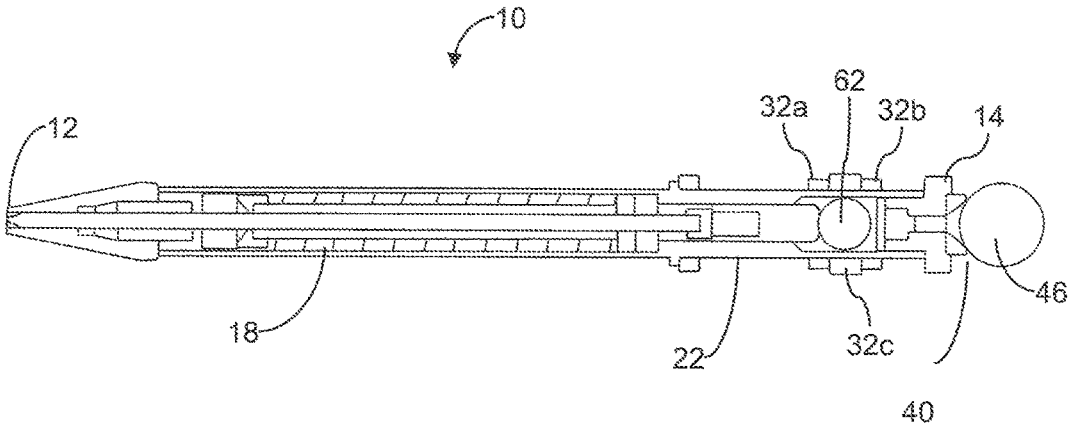
FIG. 3 is a simplified cross-sectional view of yet another embodiment of the writing instrument of the present invention in a retracted state.
Figure 4:
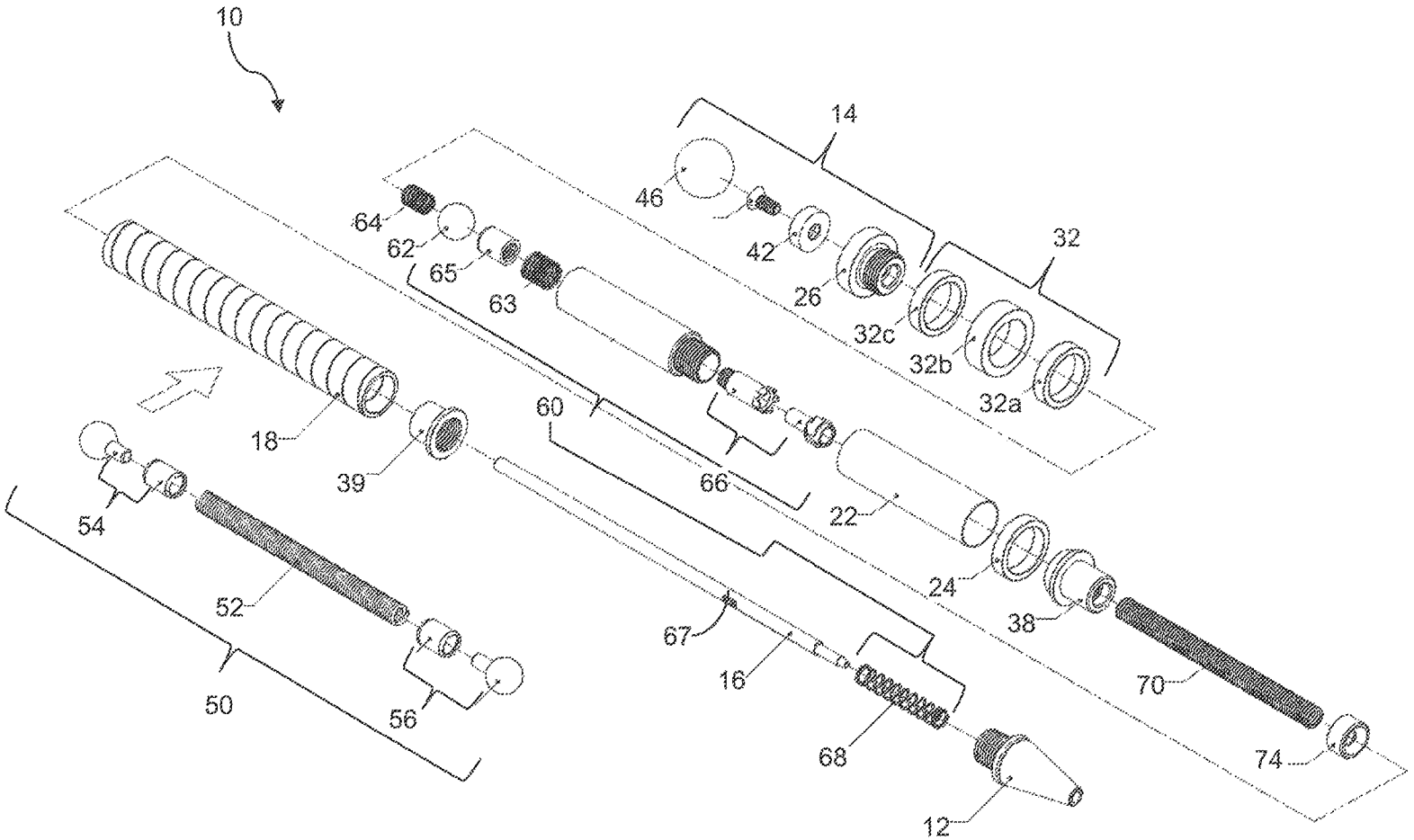
FIG. 4 is an exploded perspective view of a further embodiment of the writing instrument of the present invention.

A preferred embodiment of a retraction/extension mechanism is illustrated in the embodiment shown in FIGS. 3 and 4. Moving the slidable magnetic ring 32 along the slider portion 22 pushes a clicker cap 65 of a clicker cam assembly, which cooperates with cartridge shoulders 67 and spring 68 to extend and retract the marking component 16. The clicker cam assembly illustrated in FIG. 4 has a pair of coacting cam members 66, a clicker cap 65, and a clicker spring 63 for operably engaging the clicker cap 65 and the pair of coacting cam members 66. A spring 64 is provided to urge the internal magnet 62 against the clicker cam assembly for operably engaging the clicker cam assembly. It will be understood by those skilled in the art that other types of the clicker cam assembly are possible without departing from the spirit of the present invention.

In another embodiment of the writing instrument 10 of the present invention, depicted in FIGS. 5A, 5B, 6A and 6B, the retraction/extension mechanism is a rotatable assembly. The rotatable assembly has an inner housing 82 that is rotatable independently of the barrel 18, a sleeve 84 disposed within the inner housing 82. The sleeve 84 has a female threaded portion 86 for receiving a male threaded portion 17 of the marking component 16. The sleeve 84 can be caused to be concurrently rotated and moved axially within the inner housing 82 to extend and retract the marking component 16 through the first instrument end 12.

Figure 5A:
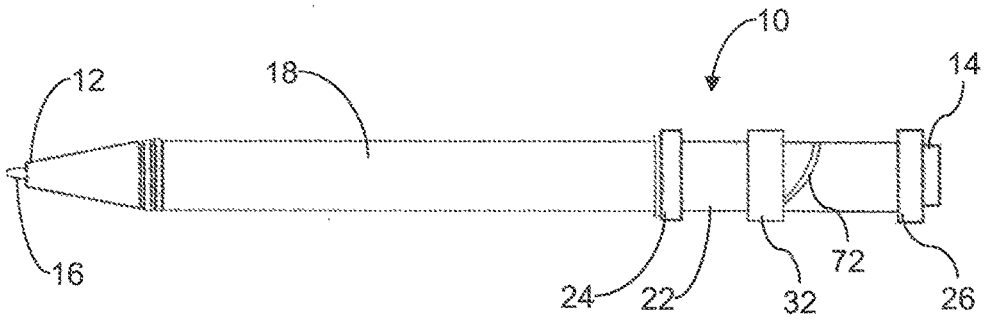
FIG. 5A is a top plan view of yet a further embodiment of the writing instrument of the present invention in an extended state.
Figure 5B:
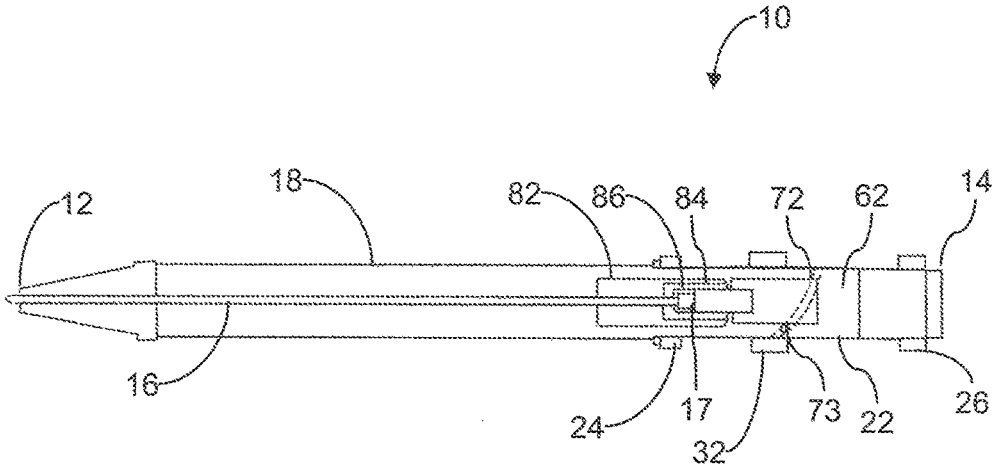
FIG. 5B is a simplified cross-sectional view of the embodiment of FIG. 5A.

In the embodiment shown in FIGS. 5A and 5B, the slider portion 22 has a helical track 72 formed in its exterior surface for defining travel of the rotatable assembly. Preferably, the slidable magnetic ring 32 has a portion, for example a post 73, that extends into the helical track, so that rotation of the slidable magnetic ring 32 moves in a defined path and magnetically engages the internal magnet 62 to travel along the path defined by the helical track to operate the rotatable assembly, thereby extracting and/or retracting the marking component 16.

Figure 6A:
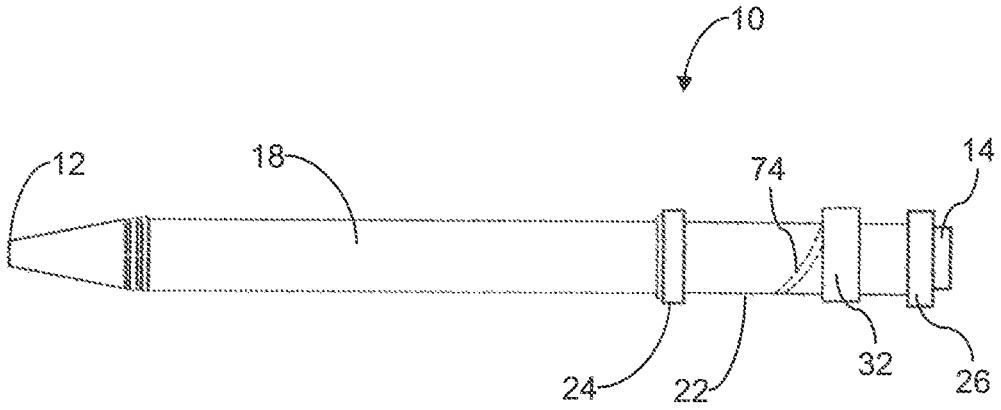
FIG. 6A is a top plan view of still another embodiment of the writing instrument of the present invention in a retracted state.
Figure 6B:
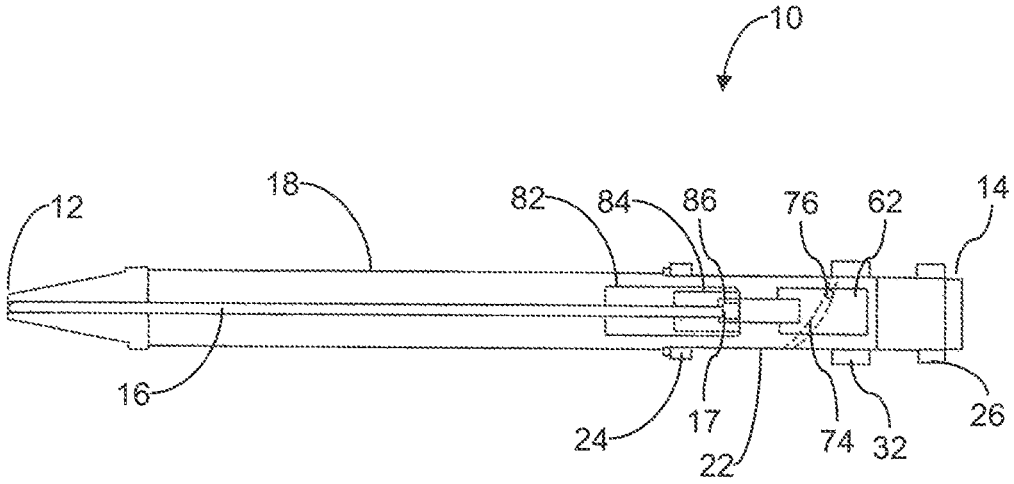
FIG. 6B is a simplified cross-sectional view of the embodiment of FIG. 6A.

In the embodiment shown in FIGS. 6A and 6B, the slider portion 22 has a helical track 74 formed in its interior surface for defining travel of the rotatable assembly. Preferably, the internal magnet 62 has a portion, for example a post 76, that extends into the helical track, so that rotation of the slidable magnetic ring 32 magnetically engages the internal magnet 62 along a path defined by the helical track 74 to operate the rotatable assembly, thereby extracting and/or retracting the marking component 16.

Figure 7:
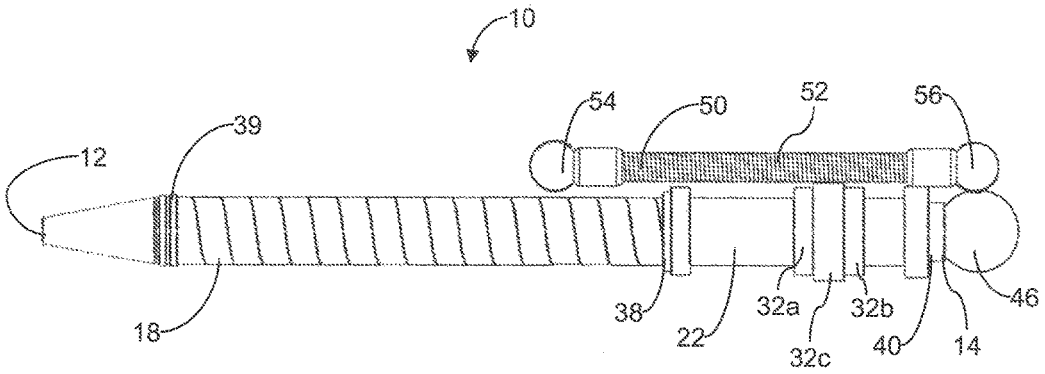
FIG. 7 is a side elevation view of another embodiment of the writing instrument of the present invention.
Figure 8:
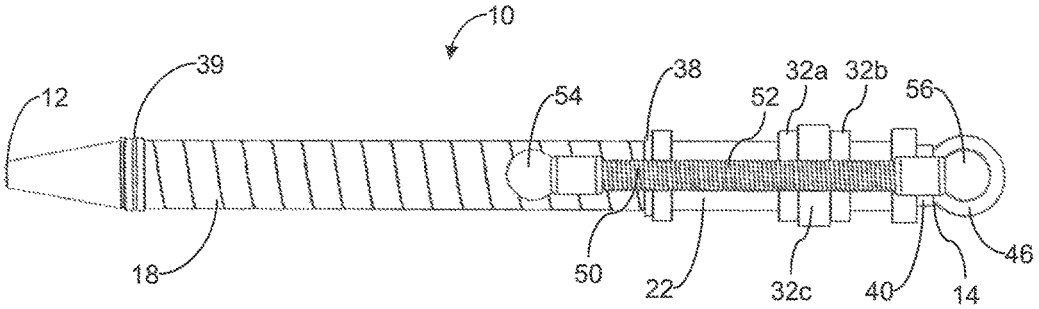
FIG. 8 is a top plan view of the writing instrument of FIG. 7.

Advantageously, the writing instrument 10 of the present invention is provided with other fidgeting components, as described in our copending application, filed concurrently herewith. For example, as illustrated in FIGS. 7 and 8, the writing instrument 10 may be provided with a detachable clip member 50. The detachable clip member 50 has a pliable clip rod 52 having a first clip end member 54 connected to one end of the clip rod 52 and a second clip end member 56 connected to the other end of the clip rod 52. The pliable clip rod 52 is preferably made with a spring, as depicted in the drawings. However, other configurations and materials are possible, without departing from the spirit of the present invention.

Preferably, the first clip end member 54 has a magnet so that the first clip end member 54 can be magnetically coupled to the barrel 18. In the embodiments discussed below, the first clip end member 54 may be coupled to other parts of the barrel 18, with the clip rod 52 in a substantially straight configuration or a bent configuration. Preferably, the first clip end member 54 has a spherical shape. This preferred embodiment allows for a number of fidgeting movements, as will be discussed in more detail below.

The second clip end member 56 is adapted to be removably and operably connected to the second instrument end 14. The operable connection between the second clip end member 56 and the second instrument end 14 may be mechanical, such as a press fit, a snap fit, a threaded engagement, or the like, magnetic or a combination thereof. Preferably, the connection between the second clip end member 56 and the second instrument end 14 is magnetic, wherein at least one of the second instrument end 14 and the second clip end member 56 has a magnetic component. More preferably, both the second instrument end 14 and the second clip end member 56 have a magnetic component.

The second clip end member 56 is also adapted to be magnetically coupled to the first clip end member 54. The second clip end member 56 may include a magnet or be formed of a ferrous material for coupling to a magnetic component.

Figure 9A:
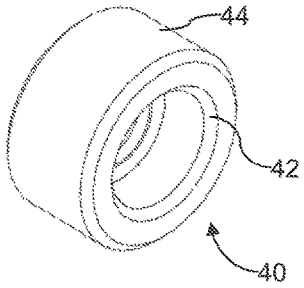
FIG. 9A is a perspective view of a magnetic collar of the FIG. 7 embodiment of the writing instrument of the present invention.
Figure 9B:
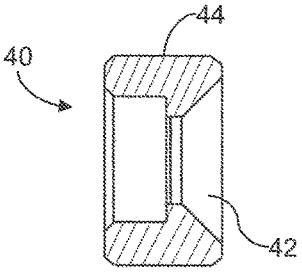
FIG. 9B is a side cross-sectional view of the magnetic collar of FIG. 9A.

In another embodiment, the second instrument end 14 has a magnetic collar 40, shown more clearly in FIGS. 9A and 9B. The magnetic collar 40 has an inner countersunk well 42 and an outer wall 44. The inner countersunk well 42 can be used for receiving the second clip end member 56. Alternatively, in a more preferred embodiment, the countersunk well 42 can receive a ferrous end sphere 46, which can serve as an intermediary connector for magnetically coupling the second clip end member 56 to the second instrument end 14.

In a preferred embodiment, as illustrated in FIGS. 7 and 8, at least a portion of the barrel 18 is a formed of a pliable material that has sufficient resiliency to allow a user to efficiently use the writing instrument 10 of the present invention to mark a writable surface, while still providing a pliable section for fidgeting. Suitable pliable materials include a round spring formed of a metal having a round cross-section, a rectangular spring formed of a metal having a rectangular cross-section, a braided material, a woven material, and combinations thereof. A more preferred pliable material is a rectangular spring formed of a metal having a rectangular cross-section, as illustrated in FIGS. 7 and 8. The pliable material is preferably formed of a ferrous material. Preferably, the portion of the barrel 18 formed of pliable material is supported by shoulders 38 and 39.

When the barrel 18 includes a pliable portion, advantageously, a cartridge spring 70 is provided for receiving the writing component 16, which is centered in the barrel 18 with centering collar 69.

While preferred embodiments of the present disclosure have been described, it should be understood that various changes, adaptations and modifications can be made therein without departing from the spirit of the invention(s) as claimed below.

We claim:

1. A retractable writing instrument having a marking component for marking a writable surface, comprising:

a first instrument end and a second instrument end, the first instrument end adapted to receive a first portion of the marking component;

a barrel for housing at least a second portion of the marking component, the barrel positioned between the first instrument end and the second instrument end;

the barrel further comprising a slider portion proximate the second instrument end;

an extension/retraction mechanism housed in the barrel and operably connected to the marking component;

an internal magnet adapted to operate the extension/retraction mechanism and positioned for operating movement along a length of the slider portion for extending and retracting a portion of the marking component through the first instrument end; and a slidable magnetic ring having an inner diameter for receiving the slider portion and adapted to magnetically cooperate with the internal magnet.

2. The writing instrument according to claim 1, wherein the slider portion is formed of a non-ferrous material.

3. The writing instrument according to claim 1, wherein the slidable magnetic ring comprises a first magnet ring, a middle non-magnet ring, and a second magnet ring.

4. The writing instrument according to claim 3, wherein the middle non-magnet ring is formed of a ferrous material.

5. The writing instrument according to claim 1, wherein the slider portion further comprises a slider stop at each end of the slider portion.

6. The writing instrument according to claim 5, wherein at least one of the slider stops is magnetic.

7. The writing instrument according to claim 1, wherein the extension/retraction mechanism comprises a clicker cam assembly.

8. The writing instrument according to claim 7, wherein the clicker cam assembly comprises a pair of coacting cam members, a clicker cap, and a clicker spring for operably engaging the clicker cap and the pair of coacting cam members.

9. The writing instrument according to claim 7, further comprising a spring for urging the internal magnet against the clicker cam assembly for operably engaging the clicker cam assembly.

10. The writing instrument according to claim 1, wherein the extension/retraction mechanism comprises a rotatable assembly.

11. The writing instrument according to claim 10, wherein the rotatable assembly comprises an inner housing adapted to rotate independently of the barrel, a sleeve disposed within the inner housing, the sleeve having a female threaded portion for receiving a male threaded portion of the marking component, the sleeve adapted for concurrent rotation and axial movement within the inner housing to extend and retract the marking component.

12. The writing instrument according to claim 11, further comprising an external helical track on the exterior of the slider portion for defining travel of the rotatable assembly.

13. The writing instrument according to claim 12, wherein the slidable magnetic ring extends into the helical track.

14. The writing instrument according to claim 11, further comprising an internal helical track on the interior of the slider portion for defining travel of the rotatable assembly.

15. The writing instrument according to claim 14, wherein the internal magnet extends into the helical track.

16. The writing instrument according to claim 1, a detachable clip member having a pliable clip rod having a first rod end and a second rod end;

a first clip end member connected to the first rod end, the first clip end member comprising a magnet adapted to be magnetically coupled to the barrel at a portion of the barrel formed of ferrous material; and a second clip end member connected to the second rod end, the second clip end member adapted to be removably and operably connected to the second instrument end, the second clip end member further adapted to be magnetically coupled to the first clip end member.

17. The writing instrument according to claim 16, wherein the second instrument end has at least a portion thereof formed of a ferrous material and second clip end member is adapted to be magnetically coupled to the second instrument end.

18. The writing instrument according to claim 17, wherein the second instrument end comprises a magnetic collar, the collar having an outer wall and an inner countersunk well.

19. The writing instrument according to claim 18, wherein the second instrument end further comprises a magnetically connectable sphere.

20. The writing instrument according to claim 19, wherein at least a portion of the barrel is comprised of a pliable material whereby the writing instrument can be moved from a bent position to a straight position.

* * * * *